United States Patent [19]

Byrne

[11] Patent Number: 4,858,680

[45] Date of Patent: Aug. 22, 1989

[54] DOOR SADDLE FOR BASEBOARD HEATING

[76] Inventor: Charles Byrne, 53 Riverside Ave., Massapequa, N.Y. 11758

[21] Appl. No.: 494,683

[22] Filed: May 17, 1983

Related U.S. Application Data

[63] Continuation of Ser. No. 249,997, Mar. 30, 1981, abandoned.

[51] Int. Cl.[4] ..... F24D 19/00

[52] U.S. Cl. ..... 165/55; 49/471

[58] Field of Search ..... 165/53, 55; 138/106, 138/110; 49/471; 52/209; 174/70 C; 104/275

[56] References Cited

U.S. PATENT DOCUMENTS

| | | | |
|---|---|---|---|
| 578,273 | 3/1897 | Smith | 49/471 X |
| 1,838,746 | 12/1931 | Day | 104/275 |
| 1,845,836 | 2/1932 | Hauser | 138/106 |
| 2,166,516 | 7/1939 | Bainbridge | 104/275 X |
| 2,544,981 | 3/1951 | Buell | 237/56 |
| 3,032,839 | 5/1962 | Miller | 49/471 X |
| 3,357,370 | 12/1967 | Walkey | 104/275 |
| 4,285,515 | 3/1981 | Owen | 138/110 X |

*Primary Examiner*—William E. Tapolcai

*Attorney, Agent, or Firm*—Brumbaugh, Graves, Donohue & Raymond

[57] ABSTRACT

This invention relates to a threshold saddle which in outward appearance resembles the usual saddle provided in doorways but which also provides a fluid channel for interconnecting baseboard radiation elements on either side of the doorway.

4 Claims, 1 Drawing Sheet

DOOR SADDLE FOR BASEBOARD HEATING

This application is a continuation of application Ser. No. 249,997, filed on Mar. 30, 1981, now abandoned.

BACKGROUND OF THE INVENTION

Baseboard radiation has become popular for heating both residential and commercial buildings. Unlike the traditional full size radiators, baseboard convectors are unobtrusive, blend in with the room decor and do not interfere with the placement of furniture in a room.

Another attractive feature of baseboard convectors is its simplicity of installation in many applications. However, while baseboard heating units are easily installed on for example, the ground floor of a building which has a basement providing ready access to pipes, buildings without basements, constructed on solid concrete foundations (sometimes referred to as "slabs"), present serious installation problems. When a baseboard heating system has to cross a doorway in a building with a basement, the circulating pipes are generally run through the floor at one side of the door under the floor beneath the doorway and then up through the floor at the other side of the doorway. In buildings without basements and where the baseboard radiation being installed is to bridge a doorway, a trench must be cut in the concrete along the threshold, the connecting pipe laid in the trench and the remainder of the trench filled with new concrete. This process is difficult, time consuming and expensive. Because of this serious drawback, baseboard heating is not often installed in buildings on slabs.

In buildings with concrete floors, the original circulating hot water or steam pipes for heating are embedded in the concrete flooring as the floors are poured. Repair of this type of heating system is costly because concrete floor must be broken up to reach the embedded pipes. Replacement of this type of heating system with baseboard convectors, an otherwise attractive alternative to costly repairs of the concrete embedded pipes, has heretofore been impracticable in many instances because of the expense and difficultly in extending connecting pipes across doorway thresholds.

SUMMARY OF THE INVENTION

In accordance with the present invention, the foregoing difficulties are overcome by means of a novel threshold saddle which in outward appearance resembles the usual saddle provided in doorway but which also provides a fluid channel for interconnecting baseboard radiation elements on either side of the doorway.

The saddle of the invention can be formed or extruded as a single element. As an alternative, the outer shell, resembling a conventional door saddle, and the fluid channel can be separately formed, the outer shell formed to fit snugly over the fluid channel. The shape of the fluid channel is not critical to the saddle but for easy connection to the fluid circulating system the channel preferably is generally circular or oval in shape. If the channel is in direct contact with the floor the bottom of the channel is preferably flat. The exterior configuration and dimensions of the saddle can be adapted to fit particular threshold variations and designs.

In order to prevent burns to children or to persons who's unprotected skin might come in contact with the device, the saddle preferably is made at least in part, from an insulating material. In some applications it may be desirable to make the saddle from a material which simulates wood or can be finished to resemble a wooden door sill. The outer shell of the saddle and the fluid channel can, however, be made from any material which will withstand temperatures up to about 212° F. (100° C.) and which are not easily broken on impact for example, copper, iron, aluminum, thermostable plastics and resins.

At either end, the saddle of the invention is adapted to receive conventional plumbing fittings for connection to the fluid circulating systems on either side of the doorway or wall opening.

Although this invention is particularly adapted for use in connecting heating systems, especially baseboard convectors, across door thresholds, it can also be used in connecting other fluid circulating systems such as cooling systems and other systems that require circulating fluids through channels across wall openings.

The invention will be better understood through a detailed description which is given for illustrative purposes only and is not meant to limit the scope of the claimed invention.

DETAILED DESCRIPTION OF THE INVENTION

Figure 1:
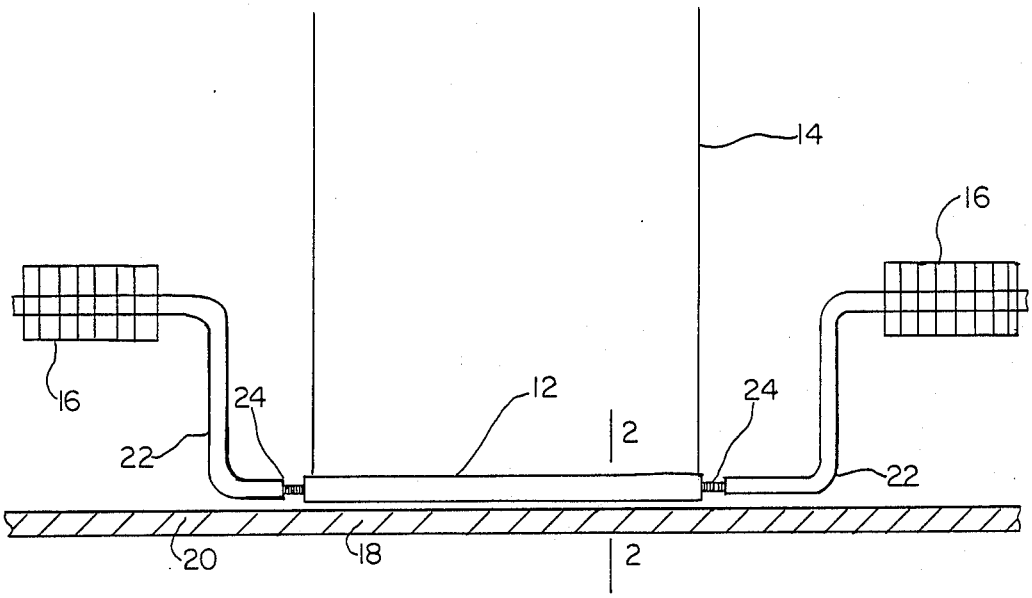
FIG. 1 is a front view of the door saddle of this invention, shown spanning a doorway and connecting baseboard convectors on either side of the doorway.

FIG. 1 shows the door saddle 12 in place spanning a doorway 14 and connecting baseboard convectors 16 on either side of the doorway 14. Preferably, the saddle bottom 18, rests on the floor 20 of the doorway 14 and is coupled to the pipes 22 of the baseboard convectors 16 by pipe unions 24.

Figure 2:
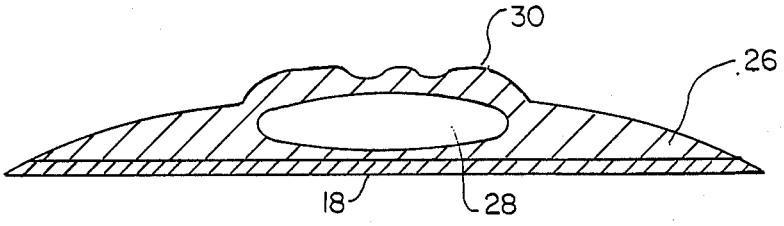
FIG. 2 is a cross-sectional view of an embodiment of the door saddle, taken along the lines 2—2 of FIG. 1.

The saddle shown in FIG. 2 in the shape of a conventional door saddle, is formed as a single unit and comprises an elongated member 26, and means defining a fluid channel 28 positioned inside the elongated member 26. The bottom 18 of the saddle is flat to allow direct contact of the saddle bottom 18 with the floor 20 and the upper surface 30 is generally convex and shields the fluid channel 28.

Figure 3:
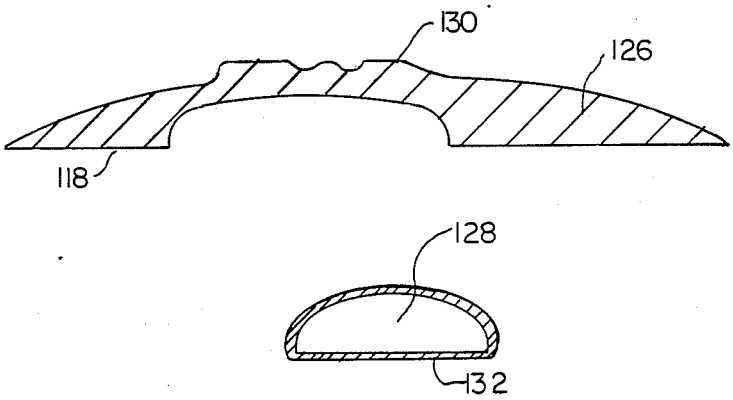
FIG. 3 is a cross-sectional view taken along lines 2—2 of FIG. 1 of an additional alternate embodiment of the door saddle of this invention separated into its component parts.

FIG. 3 shows an alternate embodiment of the door saddle illustrated in FIG. 1 wherein the elongated member 126 and the channel 128 are separately formed. The elongated member 126 has a generally convex upper surface and a generally flat bottom 118 and is formed so that it will fit snugly over the fluid channel 128 which also has a generally flat lower surface 32 to allow complete contact of the saddle 112 on the floor.

I claim:

1. A threshold saddle for connecting fluid circulating heating systems across an upper surface of a floor of a doorway comprising;

an elongated member adapted to span the doorway along the floor and having:

a generally flat lower surface for contacting the upper surface of the floor;

a means defining a fluid circulating heat channel disposed within the elongated member, said channel extending the length of said member;

a generally convex upper surface shielding the fluid circulating heat channel and substantially free from abrupt changes in grade to diminish the possibility of stumbling on the device; and connecting means at each end of said channel means for coupling to said fluid circulating health system across the upper surface of the floor of a doorway.

2. A device as described in claim 1 wherein said elongated member and said channel means are formed as a single piece from a material selected from the group consisting of plastics and resins.

3. A device as described in claim 1 wherein the fluid circulating heating system comprises baseboard convectors.

4. The device as described in claim 1 wherein said elongated member is insulated to prevent injury.

* * * * *

UNITED STATES PATENT AND TRADEMARK OFFICE

CERTIFICATE OF CORRECTION

PATENT NO. : 4,858,680

DATED : August 22, 1989

INVENTOR(S) : Charles Byrne

It is certified that error appears in the above-identified patent and that said Letters Patent is hereby corrected as shown below:

Column 3, line 9, "health" should read -- heating --.

Signed and Sealed this

Twenty-sixth Day of June, 1990

*Attest:*

HARRY F. MANBECK, JR.

*Attesting Officer*

*Commissioner of Patents and Trademarks*